US006118088A

United States Patent [19]

Thielman

[11] Patent Number: 6,118,088

[45] Date of Patent: Sep. 12, 2000

[54] ELECTRIC-SWITCH COVER

[76] Inventor: Gerhard W. Thielman, 6080 Indian Ave., San Jose, Calif. 95123

[21] Appl. No.: 09/469,568

[22] Filed: Dec. 22, 1999

[51] Int. Cl.[7] ..... H01H 9/20

[52] U.S. Cl. ..... 200/43.16; 200/321

[58] Field of Search ..... 174/53, 66, 67; 200/43.01, 43.11, 43.16, 43.18, 43.19, 43.22, 50.11, 318, 321, 322, 327, 333

[56] References Cited

U.S. PATENT DOCUMENTS 4,994,636 2/1991 Wang ..... 200/548

5,434,378 7/1995 McLean ..... 200/537

5,541,379 7/1996 Kim ..... 200/566

5,868,242 2/1999 Hall et al. ..... 200/43.14

*Primary Examiner*—Michael Friedhofer

[57] ABSTRACT

A switch cover provides an obstacle for the switch-toggle, the obstacle having a switch-obstacle position and a switch-release position. The obstacle may be held to the switch-obstacle position by a spring, which may be overcome by applying force to a release mechanism. The switch cover may be removably attached to the electric-switch.

19 Claims, 9 Drawing Sheets double-leaf spring
with pull tab

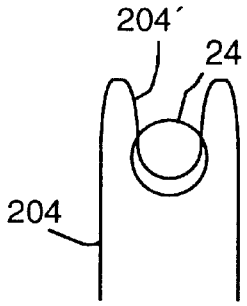
FIG. 2D
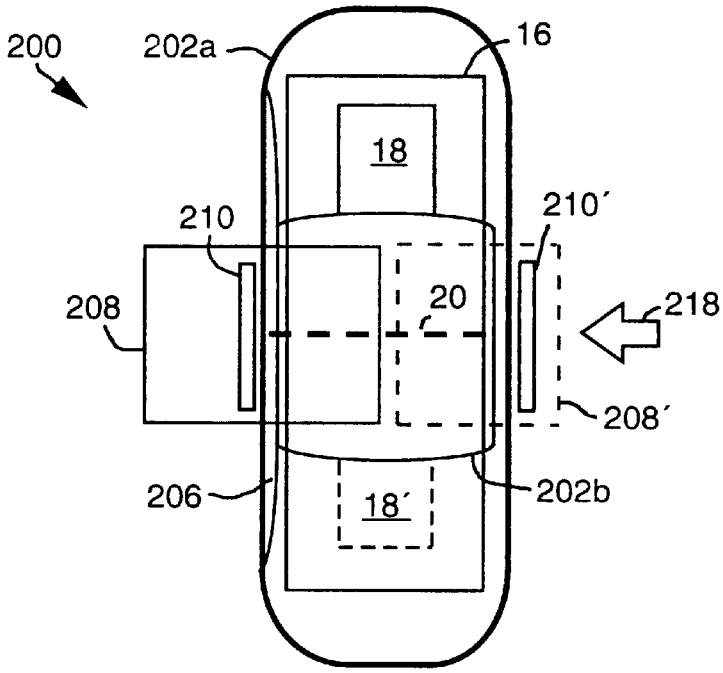
FIG. 2E
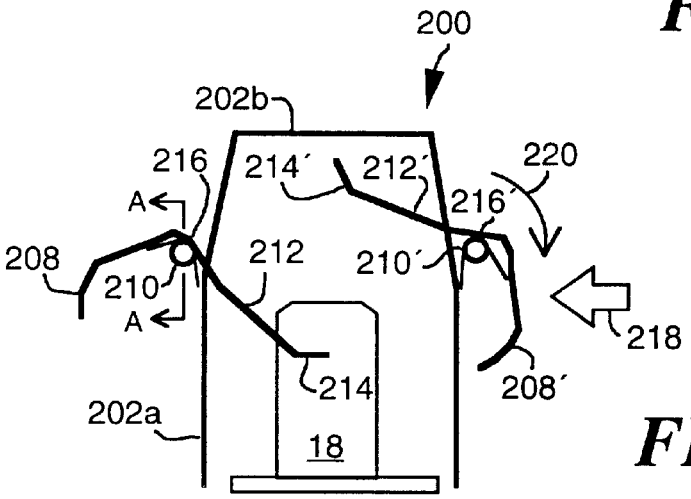
FIG. 2F
FIG. 2G
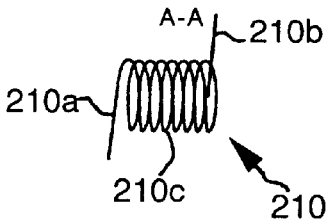

ELECTRIC-SWITCH COVER

FIELD OF THE INVENTION

The present invention relates to a dual-positional cover for an electrical control switch.

BACKGROUND OF THE INVENTION

Wall-mounted electric-switches to control electric lights (or other electrically powered devices) are a common feature in buildings equipped with alternating electric current. Such switches enable a person to freely toggle the projecting lever or switch-toggle in one of two positions relative to its pivot axis, typically closed or "on" when the switch-toggle is above or otherwise to one side of its pivot axis and open or "off" when the switch-toggle is below or otherwise to the opposite side of its pivot axis. The above (upward) and below (downward) positions of the switch-toggle correspond to a horizontally oriented pivot axis behind the plane of the cover faceplate that obscures the electrical wiring connecting the switch to the alternating current source. The amount of force required to rotate the switch-toggle along a short arc to its opposite setting is typically designed to be high enough to prevent gravity from pulling the switch-toggle from the upward position to the downward position, but also sufficiently small to enable anyone of even feeble physical exertion to easily manipulate the switch-toggle from the upward position to the downward position or vice versa.

Circumstances arise however, a switch may be set to a semi-permanent position, and the user desires to prevent inadvertent or unauthorized alteration of the switch-toggle position. One common remedy to inhibit switch toggling is applying a strip of adhesive tape covering over the switch as a visible and tactile mechanism to alert someone in visible proximity that the switch setting is not intended to be altered. However, such an artifice may appear unsightly or unprofessional, and cannot be altered without removal and/or replacement of the tape strip. In addition, upon removal of the tape strip unsightly adhesive residue may remain on the coverplate and/or the switch-toggle.

Toggle-switch covers that are hinged for removal of the toggle-obstacle have been employed for instrumentation. However, while considered appropriate for control panels, these may not be suitable for household or commercial use due to the requirement of a separate attachment mechanism for the hinge, not to mention the additional clearance volume needed to position the cover from obstruction of the switch-toggle to non-obstruction. Hence a mechanism providing a more directly utilitarian functionality in terms of attachment to an electric-switch or its cover as well as be attractive would be desirable.

SUMMARY OF THE INVENTION

A switch cover provides an obstacle for the switch-toggle, the obstacle having a switch-obstacle position and a switch-release position. The obstacle may be held to the switch-obstacle position by a spring, which may be overcome by applying force to a release mechanism. The switch cover may be removably attached to the electric-switch.

OBJECTS AND ADVANTAGES OF THE INVENTION

The electric-switch cover is intended to provide an obvious indication that an electric-switch has been toggled to a fixed position, and the switch-toggle cannot be disturbed without a deliberate effort to override the cover's passive state that holds the switch-toggle in position. A person would thereby have implied notice that permission of that authority controlling the switch setting may be required before tampering with the electric-switch. The electric-switch cover provides a removable obstacle that requires little conscious effort to override, but nonetheless reduces the risk of accidental toggling or unauthorized manipulation.

BRIEF DESCRIPTION OF THE FIGURES

FIG. 2D is a front-cross-sectional detail view diagram of an electric-switch cover faceplate flange according to a second embodiment of the present invention.

FIG. 2E is a front-cross-sectional detail view diagram of an electric-switch cover according to a second embodiment of the present invention.

FIG. 2F is a top-cross-sectional detail view diagram of an electric-switch cover according to a second embodiment of the present invention.

FIG. 2G is a front-cross-sectional detail view of a helical spring on an electricswitch cover showing the passive and forced states according to a second embodiment of the present invention.

DETAILED DESCRIPTION OF THE PREFERRED EMBODIMENTS

Those of ordinary skill in the art will realize that the following description of the present invention is illustrative only and not in any way limiting. Other embodiments of the invention will readily suggest themselves to such skilled persons after a perusal of the within disclosure.

The present invention is a device to removably obstruct a change in position of an electric-switch. The device may be installed over the surface of the faceplate cover in front of the switch-toggle and removably attached at the openings in the faceplate in which helically threaded fasteners may be inserted to secure the faceplate to the electric-switch.

The invention may be described in essence as a device with an attachment, a flange, a spring and a release mechanism. The attachment secures the device to the electric-switch or its faceplate cover. The flange may be designed for removably impeding the switch-toggle restricting it to one position when the flange is at rest or in the relaxed or passive state, and not impeding the switch-toggle when the flange is forced. The spring may be connected with the flange to hold the flange while in the passive position. The release mechanism enables the flange to be moved to the forced state, enabling the switch-toggle to be repositioned. For the within disclosure, four specific design embodiments are presented.

Pull Tab with Double-Leaf Spring Embodiment

Figure 1A:
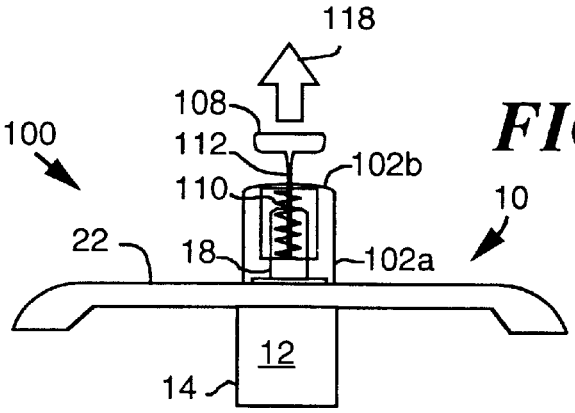
FIG. 1A is a top-cross-sectional view diagram of an electric-switch cover according to a first embodiment of the present invention.
Figure 1B:
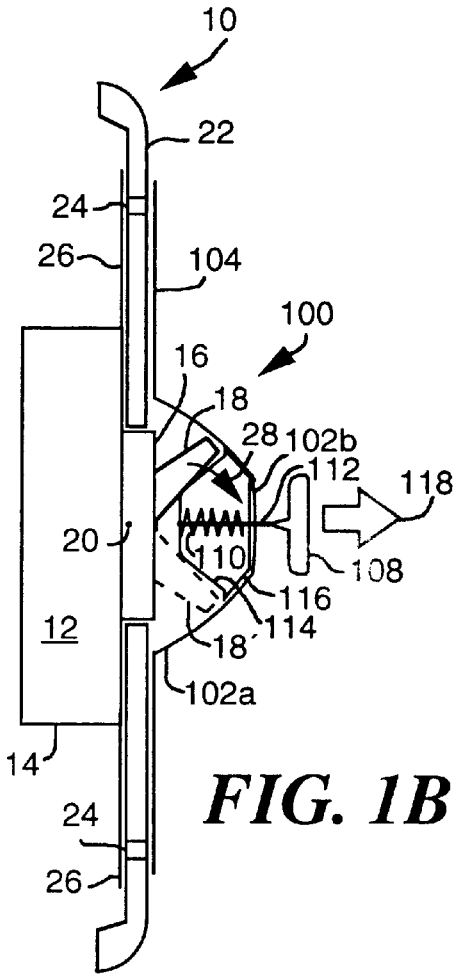
FIG. 1B is a side-cross-sectional view diagram of an electric-switch cover according to a first embodiment of the present invention.
Figure 1C:
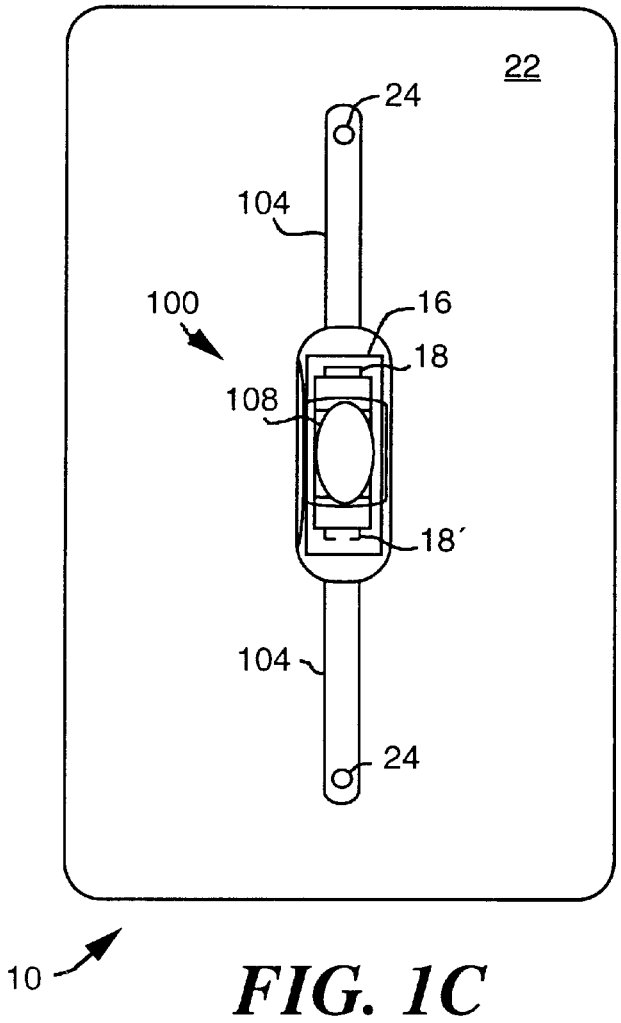
FIG. 1C is a front-cross-sectional view diagram of an electric-switch cover according to a first embodiment of the present invention.

In a first embodiment of the present invention, illustrated in FIGS. 1A, 1B and 1C, an electric-switch with a cover plate assembly 10 is shown, as is recognized by persons of ordinary skill in the art. The electric-switch 12 includes electrical housing 14, a toggle mount 16, the switch-toggle in an upward position 18, with a downward position 18' shown in dashed lines, and a toggle hinge 20. The electric-switch 12 may be secured to a wall within a junction box. The faceplate cover 22 obscures and is attached to an electric-switch 12 by means of helical threaded fasteners (not shown) such as bolts through upper and lower fastener apertures 24 on the faceplate cover 22. Each fastener passes through a switch flange 26 that is integrated to the electrical housing 14. The cooperation of each fastener through the switch flange 26 secures the faceplate cover 22 to the electric-switch 12, which is held in the electrical junction box by other attachments (not shown). The switch-toggle in the upward position 18 may be repositioned to the downward position 18' in an angular arc 28 by rotation along the toggle hinge 20. The arc volume that the switch-toggle may occupy includes the space for the switch-toggle in the upward position 18, the corresponding space for the downward position 18', and the small arc region swept by the switch-toggle while rotatably traversing between these positions 18 and 18', respectively.

Figure 1D:
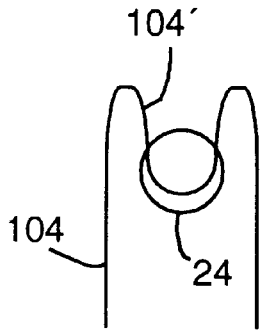
FIG. 1D is a front-cross-sectional detail view diagram of an electric-switch cover faceplate flange according to a first embodiment of the present invention.

The first embodiment cover 100 in the top view in FIG. 1A illustrates a cover top and bottom housing 102*a* and a cover front housing 102*b*, which together may be integrated as a single unit. From the views in FIGS. 1B and 1C, the cover 100 may be seen to be secured by a faceplate bracket 104, serving as the attachment, through which threaded fasteners may be received through apertures corresponding to the faceplate apertures 24. Alternatively, in FIG. 1D instead of an aperture in faceplate bracket 104 that may be flexible, fasteners may be slid into a open slot 104' and held by friction after the fasteners are screwed tightly in place against the faceplate cover 22 with faceplate bracket 104 between the fastener head and faceplate cover 22.

Figure 1E:
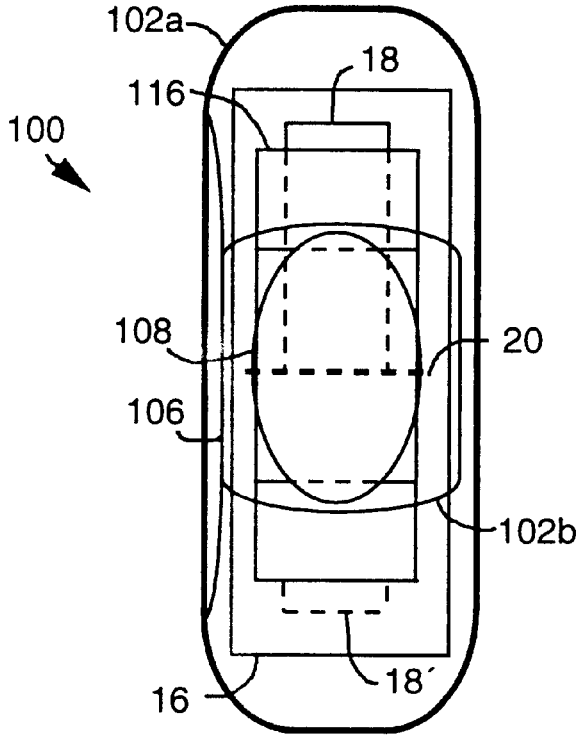
FIG. 1E is a front-cross-sectional detail view diagram of an electric-switch cover according to a first embodiment of the present invention.
Figure 1F:
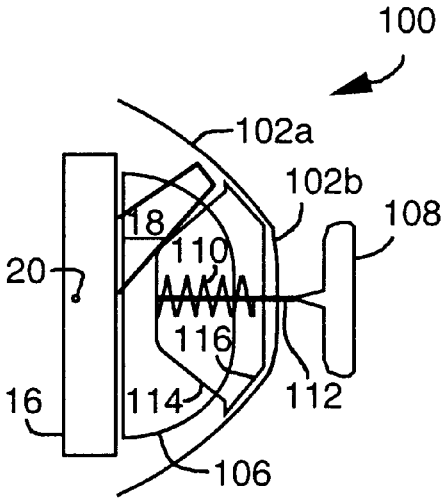
FIG. 1F is a side-cross-sectional detail view diagram of an electric-switch cover in a passive state according to a first embodiment of the present invention.
Figure 1G:
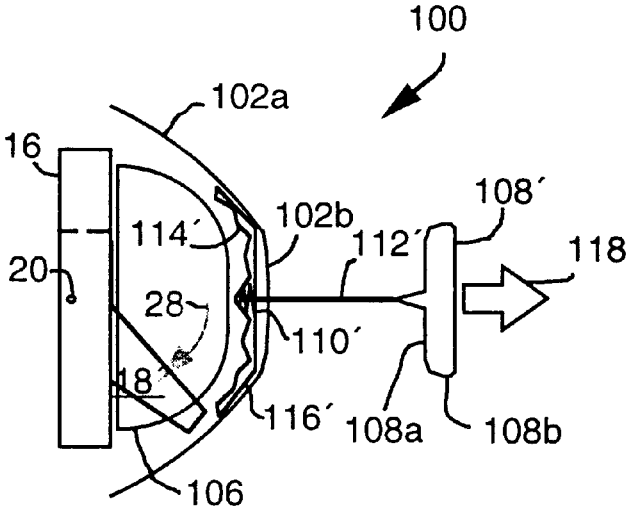
FIG. 1G is a side-cross-sectional detail view diagram of an electric-switch cover in the forced state according to a first embodiment of the present invention.

Access to reach the switch-toggle in the upward and downward positions 18 and 18' respectively should be possible from at least one side of the cover top and bottom housing 102*a* such as by a cover aperture 106 shown in FIGS. 1E, 1F and 1G. Alternatively, a cover housing, 102*a* and 102*b*, may provide only a framework to which functioning or attaching components may be connected with access to the switch-toggle sufficiently unrestricted as to obviate the need for a cover aperture 106. Extending outward from the cover front housing 102*b* is a pull tab 108, depicted with an oval planform in FIGS. 1C and 1E. Other ergonomically satisfactory shapes are also possible as alternative to the oval. By sliding a pair of fingers between the cover front housing 102*b* and the pull tab 108, the fingers may press against the tab's bottom surface 108*a* to move the pull tab 108 away from the cover front housing 102*b*. Alternatively, fingers may be applied against the tab's side edge 108*b*, using frictional shear force for moving the pull tab 108, which may be configured to be sufficiently rigid to avoid buckling from such force.

A helical spring 110 and a shaft 112 attached thereto may be oriented with their major axes perpendicular to the side of the faceplate bracket 104 facing the faceplate cover 22. The shaft 112 may be attached to the pull tab 108 so as to move together when force is applied to the pull tab 108. The helical spring 110 may hold the pull tab 108 in position towards the cover front housing 102*b* by applying tensile force between the shaft 112 and the inside surface of the cover front housing 102*b* opposite to the pull tab 108.

A detail front view of the cover 100 in the passive or relaxed position may be examined in FIG. 1E, showing the cover top and bottom housing 102*a*, cover front housing 102*b*, the side opening 106 on the left portion of the illustration, the fore-leaf 116 of the double-leaf spring, and the pull tab 108. A detail side view of the cover 100 in the passive or relaxed position may be seen in FIG. 1F, showing the cover top and bottom housing 102*a*, cover front housing 102*b*, the side opening 106, the aft and fore leaves 114 and 116 of the double-leaf spring, and the pull tab 108. The switch-toggle may be held by a double-leaf spring having an aft-leaf 114 that inhibits movement of the switch-toggle to a first position 18 and a fore-leaf 116 that by shear and tensile forces holds the double-leaf spring against or adjacent to the inside surface of the cover front housing 102*b*. The aft-leaf 114 may also be secured to inhibit the switch-toggle in the upward position 18 by the tensile force from helical spring 110. The shaft 112 may be connected at the outside end to the pull tab 108, and at the inside end to the aft-leaf 114. The pull tab 108 and shaft 112 serve the role of release mechanism.

A detail side view shown of the cover 100 in the forced or retracted position may be seen in FIG. 1G featuring the double-leaf spring having been retracted with the aftleaf 114' adjacent to the fore-leaf 116', and thereby removing the impediment to the switch-toggle for placement in the downward position 18'. The aft-leaf 114' of the double-leaf spring may be disengaged from the switch-toggle by applying force 118 on the pull tab 108' away from the cover front housing 102*b* pulling the shaft 112' outward from the cover front housing 102*b*, contracting the helical spring 110', thus collapsing the aft-leaf 114' against the fore-leaf 116' towards the inside surface of the cover front housing 102*b*. A finger inserted through the cover aperture 106 enables the switch-toggle to be repositioned from the upward position 18 to the downward position 18' after the aft-leaf 114' has been retracted. A retractable locking mechanism might also be included in this design to hold the shaft 112' in the pulled position while the switch-toggle is being repositioned. When the pull tab 108', having been depressed in FIG. 1G, is released to the relaxed position of pull tab 108, the helical spring 110 restores the elements to their relaxed states shown in FIG. 1F, thus demonstrating switch cover reversibility.

Push Lever with Spring Hinge Embodiment

Figure 2A:
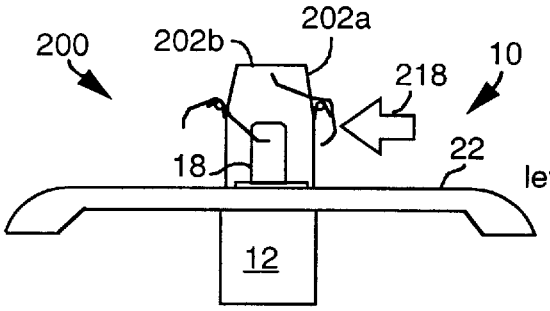
FIG. 2A is a top-cross-sectional view diagram of an electric-switch cover according to a second embodiment of the present invention.
Figure 2B:
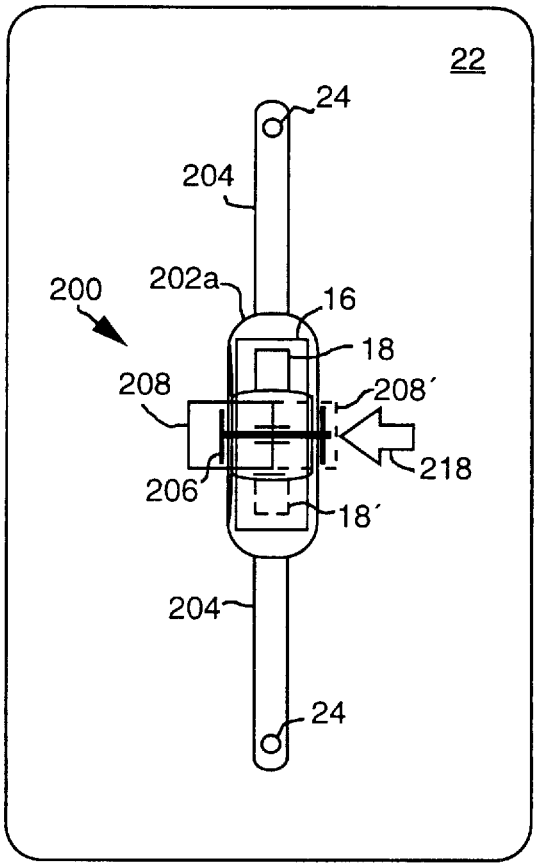
FIG. 2B is a side-cross-sectional-view diagram of an electric-switch cover according to a second embodiment of the present invention.
Figure 2B:
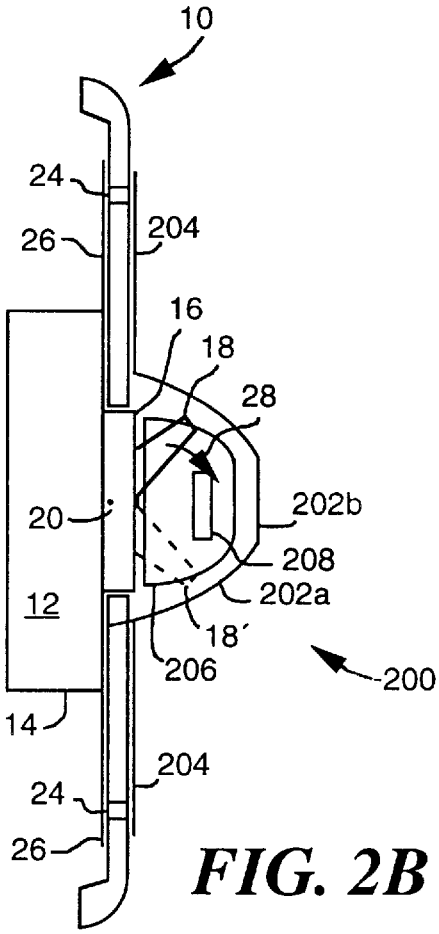
Figure 2C:
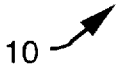
FIG. 2C is a front-cross-sectional view diagram of an electric-switch cover according to a second embodiment of the present invention.

In a second embodiment of the present invention, illustrated in FIGS. 2A, 2B and 2C, an electric-switch with a cover plate assembly 10 is shown with the same features as shown in FIGS. 1A, 1B and 1C. These include the electric-switch 12, electrical housing 14, toggle mount 16, switch-toggle in the upward and downward positions 18 and 18' respectively, toggle hinge 20, faceplate cover 22, fastener apertures 24, switch flange 26, and angular arc 28 through which the switch-toggle may travel. These items need not be discussed further.

The second embodiment cover 200 in the top view in FIG. 2A illustrates a cover top and bottom housing 202*a* and a cover front housing 202*b*, which together may be integrated as a single unit. From the views in FIGS. 2B and 2C, the cover 200 may be seen to be secured by a faceplate bracket 204 through which threaded fasteners may be received through apertures corresponding to the faceplate apertures 24. Alternatively in FIG. 2D instead of an aperture in faceplate bracket 204 that may be flexible, fasteners may be slid into a open slot 204' and held by friction after the fasteners are screwed tightly in place against the faceplate cover 22 with faceplate bracket 204 between the fastener head and faceplate cover 22.

A helical spring 210 with the axis perpendicular to toggle hinge 20 and parallel to the faceplate bracket 204, holds the push lever 208 in position away from the cover top and bottom housing 202*a* by applying torsional force between the push lever 208 and the exterior surface of the cover top and bottom housing 202*a*. A connecting flange 212 may be attached to the push lever 208, with one end connected to a restraining flange 214 and a connecting joint 216 at which to join the push lever 208. A restraining flange 214 attached thereto may be oriented with their major axes perpendicular to the side of the faceplate bracket 204 facing the faceplate cover 22. The connecting flange 212 need not be flat, but may incorporate curvature to match the contour of the toggle in positions 18 and 18' or in an intermediate position.

The connecting flange 212 cooperates with the push lever 208 and the restraining flange 214 so that when an applied force 218 is imposed against the push lever 208 to overcome the torsion from the helical spring 210, the connecting flange 212 pivots at the joint 216 to rotate the restraining flange 214 away from the switch-toggle midway between the positions 18 and 18' respectively. The restraining flange 214 may thus be repositioned so as to not impede the switch-toggle from switching from the upward position 18 to the downward position 18' or vice versa, provided the applied force 218 is sufficient against the push lever 208 for its rotation pivoting at the joint 216 by overcoming the torsion from the helical spring 210. Pressing a finger against the facing surface of push lever 208 with applied force 218 towards the switch-toggle moves the push lever 208 in an arc 220.

Access to reach the switch-toggle in the upward and downward positions 18 and 18' respectively, should be possible from at least one side of the cover top and bottom housing 202*a* such as by a cover aperture 206 shown in FIG. 2E on the left side. Alternatively, a cover housing, 202*a* and 202*b*, may provide only a framework to which functioning or attaching components may be connected with access to the switch-toggle sufficiently unrestricted as to obviate the need for a cover aperture 206. Extending outward to the side between the cover top and bottom housing 202*a* is a push lever 208, depicted with a curved flange in FIGS. 2A and 2F on the opposite side of the cover aperture 206. Other ergonomically satisfactory shapes are also possible as alternative to the curved flange.

A detail front view of the cover 200 in the passive or relaxed position may be examined in FIG. 2E left side, showing the cover top and bottom housing 202*a*, cover front housing 202*b*, the side opening 206 on the left portion of the illustration, the push lever 208 in the passive position on the left side and the push lever 208' under force on the right side. A detail top view of the cover 200 in the passive or relaxed position may be seen on the left side of FIG. 2F, showing the cover top and bottom housing 202*a*, cover front housing 202*b*, push lever 208, helical spring 210, connecting flange 212, restraining flange 214, and joint 216. The switch-toggle may be removably held by the restraining flange 214 inhibiting movement of the switch-toggle to a first position 18 and the helical spring 210 that holds the push lever 208 to the exterior surface of the cover top and bottom housing 202*a* at the joint 216. The push lever 208 and connecting flange 212 serve together as a release mechanism for the restraining flange 214.

The helical spring 210 may be seen in greater detail in FIG. 2G reoriented from the FIG. 2F cross-section A—A. The helical spring features an integral metal or other elastic filament with a first straight portion of wire 210*a*, a coil 210*b* and a second straight wire 210*c*. The wire ends 210*a* and 210*c* may be angularly separated by an angle appropriate to maintain the push lever 208 outward from the cover top and bottom housing 202*a*, such as about 270° as shown in FIG. 2F left side.

A detail top view shown of the cover 200 in the forced or retracted position may be seen on the FIG. 2F right side, showing as altered from the relaxed left side, push lever 208', helical spring 210', connecting flange 212', restraining flange 214', joint 216', applied force 218 and lever arc of travel 220. While the illustration implies two separate mechanisms on both left and right sides of the cover 200, the design is intended to indicate the relaxed position on the left side, and the same mechanism in the forced or retracted position on the right side.

The right side features the push lever 208' having been retracted with the restraining flange 214' adjacent to the joint 216', and thereby removing the impediment to the switch-toggle for placement in the downward position 18'. The restraining flange 214' may be disengaged from the switch-toggle by applying force 218 on the push lever 208' towards the switch-toggle midway between the positions 18 and 18' respectively, which rotates the connecting flange 212' outward towards the cover front housing 202*b*, placing the helical spring 210' in torsion, thus rotating the restraining flange 214' away from the switch-toggle in the upward position 18. The restraining flange 214' rotates at or near the hinge at joint 216' to cover an angle sufficient to enable the switch-toggle to be moved from upward position 18 to downward position 18' and vice versa.

The angular separation for the ends of helical spring 210' when in the forced position may be expanded to or beyond about 310° as illustrated in this example. A finger inserted through the cover aperture 206 enables the switch-toggle to be repositioned from the upward position 18 to the downward position 18' after the restraining flange 214' has been retracted. A retractable locking mechanism might also be included in this design to hold the connecting flange 212' in the forced state while the switch-toggle is being repositioned. When the push lever 208', having been depressed on the right side of FIG. 2F, is released to the relaxed state for push lever 208, the helical spring 210 restores the elements to the positions shown on the left side of FIG. 2F.

Side Button with Spring Mounted Lever Embodiment

Figure 3A:
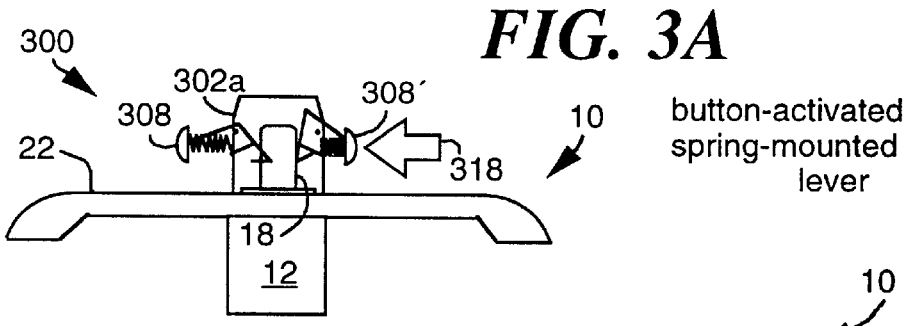
FIG. 3A is a top-cross-sectional view diagram of an electric-switch cover according to a third embodiment of the present invention.
Figure 3B:
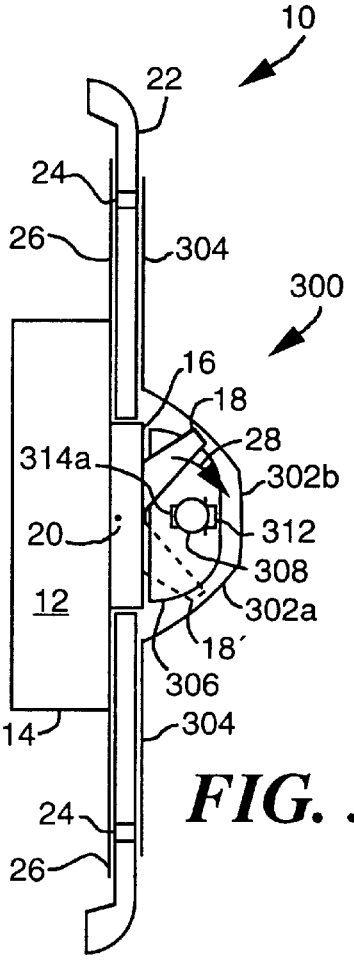
FIG. 3B is a side-cross-sectional view diagram of an electric-switch cover according to a third embodiment of the present invention.
Figure 3C:
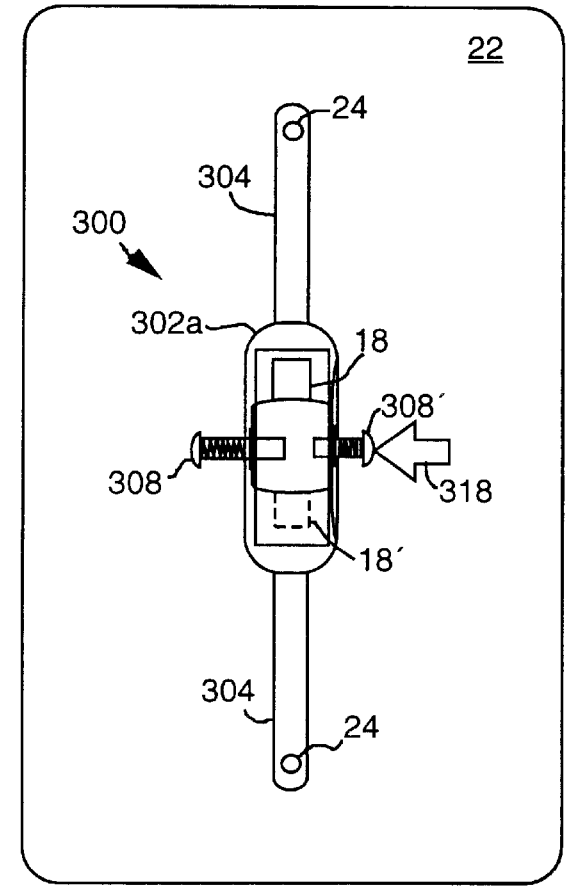
FIG. 3C is a front-cross-sectional view diagram of an electric-switch cover according to a third embodiment of the present invention.
Figure 3C:
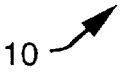

In a third embodiment of the present invention, illustrated in FIGS. 3A, 3B and 3C, an electric-switch with a cover plate assembly 10 is shown with the same features as shown in FIGS. 1A, 1B and 1C. These include the electric-switch 12, electrical housing 14, toggle mount 16, switch-toggle in the upward and downward positions 18 and 18' respectively, toggle hinge 20, faceplate cover 22, fastener apertures 24, switch flange 26, and angular arc 28 through which the switch-toggle may travel. These items need not be discussed further.

Figure 3D:
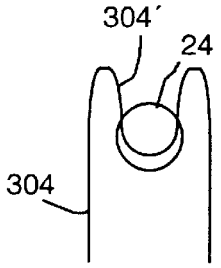
FIG. 3D is a front-cross-sectional detail view diagram of an electric-switch cover faceplate flange according to a third embodiment of the present invention.

The third embodiment cover 300 in the top view in FIG. 3A illustrates a cover top and bottom housing 302*a* and a cover front housing 302*b*, which together may be integrated as a single unit. From the views in FIGS. 3B and 3C, the cover 300 may be seen to be secured by a faceplate bracket 304 through which threaded fasteners may be received through apertures corresponding to the faceplate apertures 24. Alternatively in FIG. 3D instead of an aperture in faceplate bracket 304 that may be flexible, fasteners may be slid into a open slot 304' and held by friction after the fasteners are screwed tightly in place against the faceplate cover 22 with faceplate bracket 304 between the fastener head and faceplate cover 22.

Figure 3E:
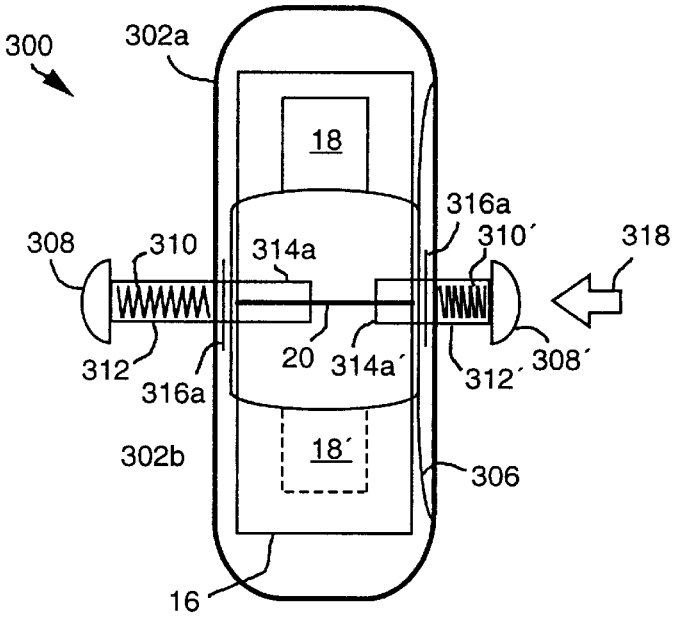
FIG. 3E is a front-cross-sectional detail view diagram of an electric-switch cover according to a third embodiment of the present invention.

Access to reach the switch-toggle in the upward and downward positions 18 and 18' respectively should be possible from at least one side of the cover top and bottom housing 302*a* such as by a cover aperture 306 shown in FIG. 3E on the right side. Alternatively, a cover housing, 302*a* and 302*b*, may provide only a framework to which functioning or attaching components may be connected with access to the switch-toggle sufficiently unrestricted as to obviate the need for a cover aperture 306. Extending outward from the cover top and bottom housing 302*a* on the opposite side as the cover aperture 306 is a push button 308, depicted with a circular planform with a rounded exposed surface in FIG. 3B. Other ergonomically satisfactory shapes are also possible as alternative to the round button. The push button 308 may be either composed of a deformably elastic material, or instead of a stiff and rigid substance.

Figure 3F:
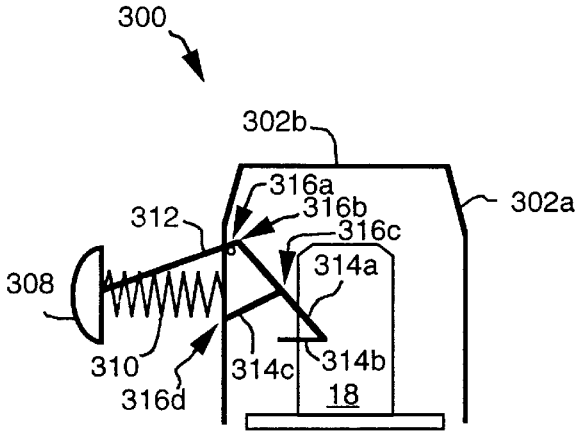
FIG. 3F is a top-cross-sectional detail view diagram of an electric-switch cover in a passive state according to a third embodiment of the present invention.

A detail front view of the cover 300 in the passive or relaxed position may be examined on the left side of FIG. 3E, showing the cover top and bottom housing 302*a*, cover front housing 302*b*, the side opening 306 on the right portion of the illustration, the push button 308, the helical spring 310, the outer flange 312, and the inner flange 314*a* of the lever assembly. A detail top view of the cover 300 in the passive or relaxed position may be seen in FIG. 3F, showing the cover top and bottom housing 302*a*, cover front housing 302*b*, the push button 308, the helical spring 310, the inner and engaging flanges 314*a* and 314*b* of the lever assembly, and the restricting flange 314*c*, the slide axle 316*a*, the outer-inner flange joint 316*b*, the inner-restraining joint 316*c* and the restricting-housing joint 316d. The outer flange 312 may have a curved planform so as not to interfere with the contraction and release of the helical spring 310. Alternatively, the helical spring 310 may be replaced by another tension-supplying component with a less symmetrical contour than a spiral coil.

The outer flange 312 may be connected to inner flange 314*a* of the lever assembly at joint 316*b* and slide along slide axle 316*a*. The inner flange 314*a* may be rigidly connected to an engaging flange 314*b* that holds the switch-toggle to either the upward or downward positions 18 or 18'. The inner flange 314*a* may also be pivotably connected to a restricting flange 314*c* at restraining joint 316*c*, for holding inner flange 314*a* towards the inner surface of the cover top and bottom housing 302*a*. The engaging flange 314*b* may thereby be moved in conjunction with the other flanges.

The restricting flange 314*c* may be pivotably pinned to the cover top and bottom housing 302*a* at a housing joint 316*d*. The push button 308 is held away from the cover top and bottom housing 302*a* by the tensile force from helical spring 310. When the push button 308' is pressed by applied force 318, such as by a finger, towards the cover top and bottom housing 302*a*, the helical spring 310' may be compressed and the outer flange 312' slides along slide axle 316*a'* and rotate forward (away from faceplate cover 22). The combination of flanges 312, 314*a*, 314*b* and 314*c*, along with the accompanying hinges and joints 316*a*, 316*b*, 316*c* and 316*d* may constitute a set of linkages that interact together. The push button 308 and outer flange 312 represent part of the release mechanism acting in concert with the hinges and other flanges.

The outer flange 312 may be held away from the cover top and bottom housing 302*a* by the helical spring 310. The switch-toggle may be held by lever assembly having an inner flange 314*a* attached to the outer flange 312 and an engaging flange 314*b* that inhibits movement of the switch-toggle to the upward position 18. The engaging flange 314*b* of the lever assembly may be secured to inhibit the switch-toggle in the upward position 18 by the combination of forces from helical spring 310 and the pinned restraints between the interconnected flanges 312, 314*a*, 314*c* at their respective hinges or joints 316*a*, 316*b*, 316*c* and 316*d*.

The outer flange 312 may be connected at the outer end to the push button 308, and at the inner end to the inner flange 314*a* at the outer-inner joint 316*b*. The outer flange may pivotally slide along the slide axle 316*a* into the cover top and bottom housing 302*a*. The inner flange 314*a* may be connected to the engaging flange 314*b* in a manner so that the angle formed at their intersection may remain fixed. The inner flange 314*a* may also be connected to the restricting flange 314*c* at the restraining joint 316*c*, to pull the inner and engaging flanges 314*a* and 314*b* away from the switch-toggle. The restricting flange 314*c* may also be pivotally restricted from translation by being connected to the cover top and bottom housing 302*a* at the housing joint 316*d*.

A detailed front view of the cover 300 in the forced or retracted position may be shown on the right side of FIG. 3E. A detail top view of the cover 300 in the forced or retracted position may be seen in FIG. 3G featuring the outer flange 312' having been retracted with the engaging flange 314*b*' adjacent to the inner flange 314*a*', and thereby removing the impediment to the switch-toggle for placement in the downward position 18'. The engaging flange 314*b*' may be disengaged from the switch-toggle by applying force 318 on the push button 308' towards the side of the cover top and bottom housing 302*a* contracting the helical spring 310' and pushing the outer flange 312' inward towards the cover top and bottom housing 302*a*. With the outer flange 312' rotating the inner flange 314*a*' towards the cover front housing 302*a* and the restricting flange 314*c* to restrict inner flange 314*a*' towards the cover top and bottom housing 302*a*, thus translatably rotating by angle 320 the inner flange 314*a*' with the engaging flange 314*b*' towards the inner surface of the cover top and bottom housing 302*a* and thereby being retracted away from the switch-toggle.

Figure 3G:
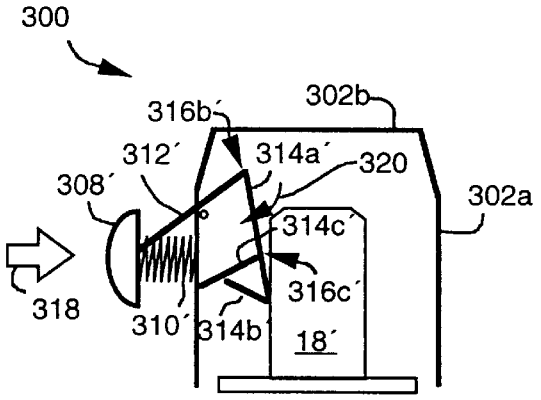
FIG. 3G is a top-cross-sectional detail view diagram of an electric-switch cover in the forced state according to a third embodiment of the present invention.

A finger inserted through the cover aperture 306 enables the switch-toggle to be repositioned from the upward position 18 to the downward position 18' after the engaging flange 314*b*' has been retracted. A retractable locking mechanism might also be included in this design to hold the outer flange 312' in the pulled position while the switch-toggle is being repositioned. When the push button 308' having been depressed in FIG. 3G, is released to the relaxed position for the push button 308, the helical spring 310 restores the elements to their relaxed states shown in FIG. 3F.

Front Button with Rotatable Jaw Embodiment

Figure 4A:
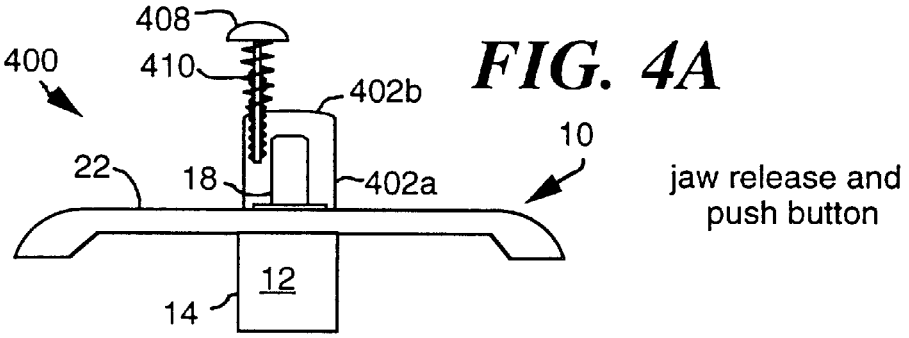
FIG. 4A is a top-cross-sectional view diagram of an electric-switch cover according to a fourth embodiment of the present invention.
Figure 4B:
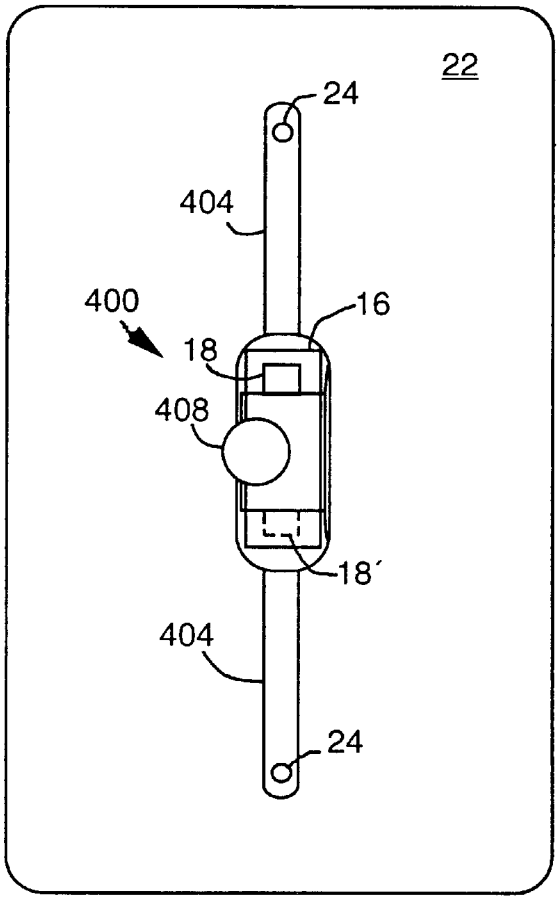
FIG. 4B is a side-cross-sectional view diagram of an electric-switch cover according to a fourth embodiment of the present invention.
Figure 4B:
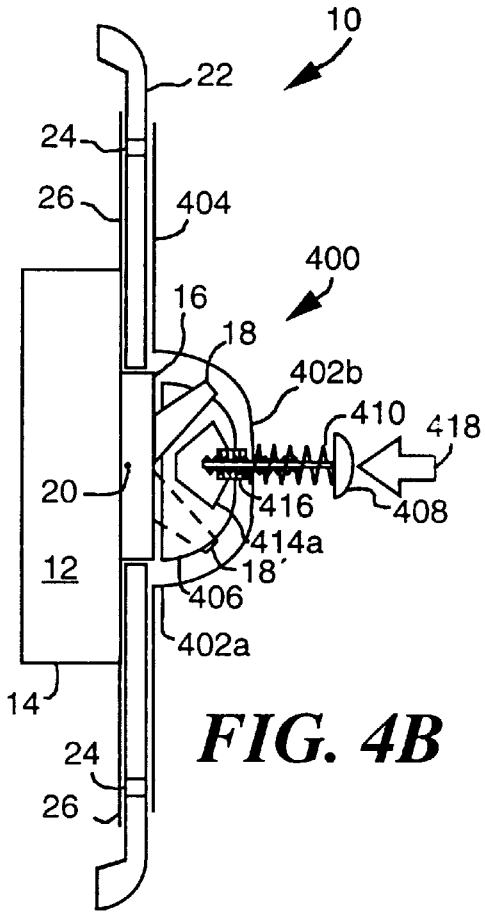
Figure 4C:
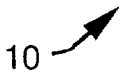
FIG. 4C is a front-cross-sectional view diagram of an electric-switch cover according to a fourth embodiment of the present invention.

In a fourth embodiment of the present invention, illustrated in FIGS. 4A, 4B and 4C, an electric-switch with a cover plate assembly 10 is shown with the same features as shown in FIGS. 1A, 1B and 1C. These include the electric-switch 12, electrical housing 14, toggle mount 16, switch-toggle in the upward and downward positions 18 and 18' respectively, toggle hinge 20, faceplate cover 22, fastener apertures 24, switch flange 26, and angular arc 28 through which the switch-toggle may travel. These items need not be discussed further.

Figure 4D:
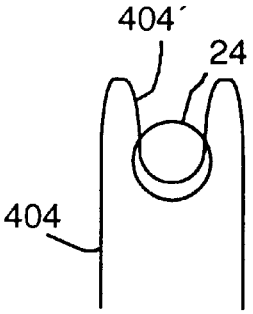
FIG. 4D is a front-cross-sectional detail view diagram of an electric-switch cover faceplate flange according to a fourth embodiment of the present invention.

The fourth embodiment cover 400 in the top view in FIG. 4A illustrates a cover top and bottom housing 402*a* and a cover front housing 402*b*, which together may be integrated as a single unit. From the views in FIGS. 4B and 4C, the cover 400 may be seen to be secured by a faceplate bracket 404 through which threaded fasteners may be received through apertures corresponding to the faceplate apertures 24. Alternatively in FIG. 4D, instead of an aperture in faceplate bracket 404 that may be flexible, fasteners may be slid into a open slot 404' and held by friction after the fasteners are screwed tightly in place against the faceplate cover 22 with faceplate bracket 404 between the fastener head and faceplate cover 22.

Figure 4E:
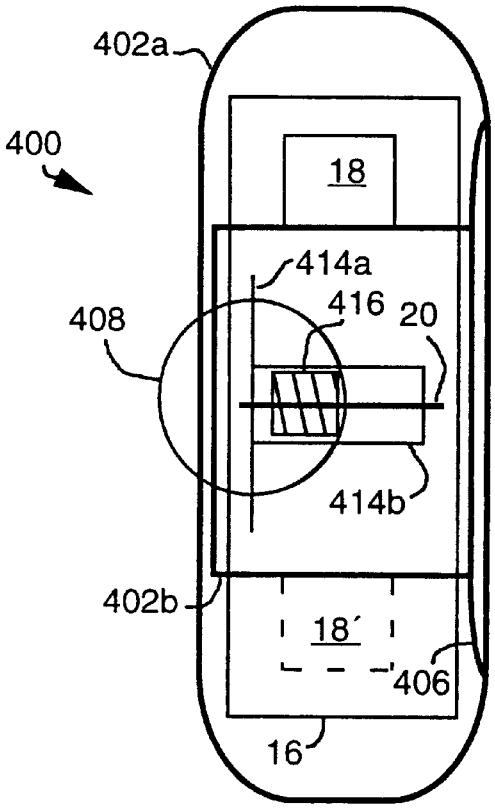
FIG. 4E is a front-cross-sectional detail view diagram of an electric-switch cover according to a fourth embodiment of the present invention.

Access to reach the switch-toggle in the upward and downward positions 18 and 18' respectively, should be possible from at least one side of the cover top and bottom housing 402*a* such as by a cover aperture 406 shown in FIG. 4E on the right side. Alternatively, a cover housing, 402*a* and 402*b*, may provide only a framework to which functioning or attaching components may be connected with access to the switch-toggle sufficiently unrestricted as to obviate the need for a cover aperture 406. Extending outward from the cover front housing 402*b* on the opposite side as the cover aperture 406 is a push button 408, depicted with a circular planform with a rounded exposed surface in FIG. 4B. Other ergonomically satisfactory shapes are also possible as alternative to the round button. The push button 308 may be composed of an elastomeric material to receive a finger and/or a stiff and rigid substance as the base.

A helical spring 410 and a shaft 412 attached thereto may be oriented with their major axes perpendicular to the side of the faceplate bracket 404 facing the faceplate cover 22. The shaft 412*a* may have a helical screw 412*b*, and may be connected with the push button 408 so as to move together in towards the cover front housing 402*a* when force is applied to the push button 408. The helical spring 410 holds the push button 408 in position away from the cover front housing 402*b* by applying tensile force between the shaft 412*a* and the outer surface of the cover front housing 402*b* opposite to the push button 408. The helical spring 410 may comprise the shape of a spiral (or helical) coil.

Figure 4F:
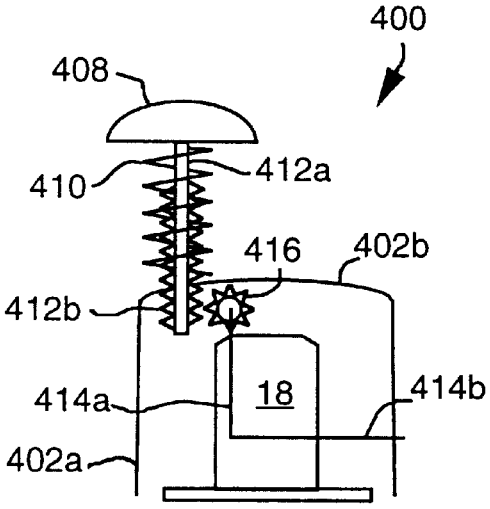
FIG. 4F is a top-cross-sectional detail view diagram of an electric-switch cover in a passive state according to a fourth embodiment of the present invention.

A detail front view of the cover 400 in the passive or relaxed position may be examined in FIG. 4E, showing the cover top and bottom housing 402*a*, cover front housing 402*b*, the side opening 406 on the right portion of the illustration, the push button 408, the attaching and the engaging flanges 414*a* and 414*b* respectively on a rotatable jaw, and the pinion 416 rigidly connected with the attaching flange 414*a*. A detail top view of the cover 400 in the passive or relaxed position may be seen in FIG. 4F, showing the cover top and bottom housing 402*a*, cover front housing 402*b*, the push button 408, the helical spring 410, the shaft shank 412*a* and helical screw 412*b* of the threaded shaft, the attaching flange 414*a*, the engaging flange 414*b*, and the pinion 416. The interaction of these elements is described below.

Figure 4G:
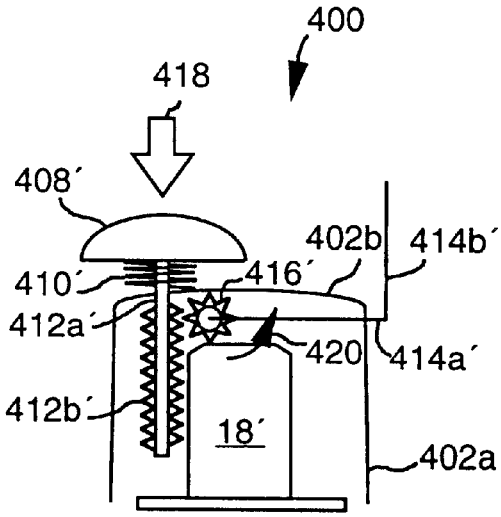
FIG. 4G is a top-cross-sectional detail view diagram of an electric-switch cover in the forced state according to a fourth embodiment of the present invention.

FIG. 4G shows a detail top view of the cover 400 in the forced or retracted position. Items featured include both cover housing portions 402*a* and 402*b*, the push button 408' being depressed by force 418, the helical spring 410' being compressed, the shaft shank 412*a*' with helical screw 412*b*' being depressed, the attaching and engaging flanges 414*a*' and 414*b*' with the pinion 416' having been rotated across angle 420.

The switch-toggle may be held by an engaging flange 414*b* that inhibits movement of the switch-toggle to a first position shown as upward position 18. The planform of the engaging flange 414*b*, shown as a flat rectangle (with one end attached to the attaching flange 414*a*) in FIG. 4E, may alternatively assume a shape that follows the contour of the switch-toggle between the upward and downward positions 18 and 18', or an intermediate position, such as by a gap within the planform. An attaching flange 414*a* may be rigidly connected at one end to the engaging flange 414*b* and at the opposite end to a pinion 416 that may be cooperatively in contact with the helical screw 412*b* on the shaft shank 412*a*. The push button 408, shaft/screw 412*a*/412*b* and pinion 416 serve together as the release mechanism of the engaging flange 414*b*.

By pressing a finger against the push button 408' to apply force 418, the helical spring 410' can be compressed. As a consequence, the shaft shank 412*a*' connected to push button 408' and threaded shaft with helical screw 412*b*' connected to shaft shank 412*a* translate toward the faceplate cover 22. As the spiral teeth of helical screw 412*b*' translate, the pinion 416' rotates in an arc along angle 420 by interaction with the pinion's gear teeth. The attaching flange 414*a*' rotates with the pinion 416', being rigidly connected thereto, thereby rotating the engaging flange 414*b*' also so as to not inhibit movement of the switch toggle to its downward position 18'.

A finger inserted through the cover aperture 406 enables the switch-toggle to be repositioned from the upward position 18 to the downward position 18' after the engaging flange 414*b*' has been retracted. A retractable locking mechanism might also be included in this design to hold the shaft shank 412*a*' in the pushed position while the switch-toggle is being repositioned. When the push button 408' having been depressed in FIG. 4G, is released to the relaxed position for push button 408, the helical spring 410 restores the elements to the positions shown in FIG. 4F.

Figure 4H:
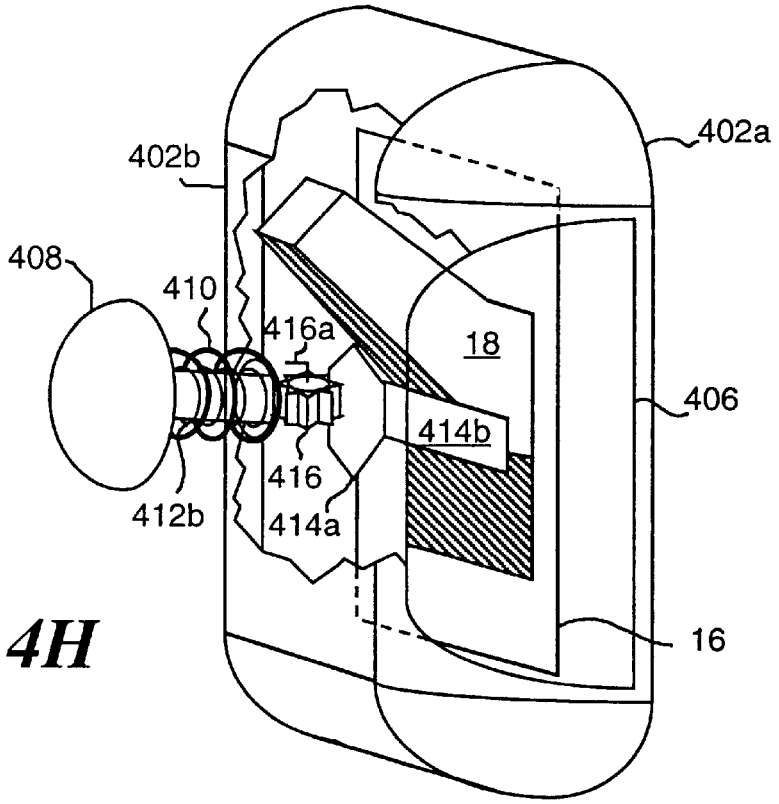
FIG. 4H is an isometric view diagram of an electric-switch cover in the passive state according to a fourth embodiment of the present invention.
Figure 4I:
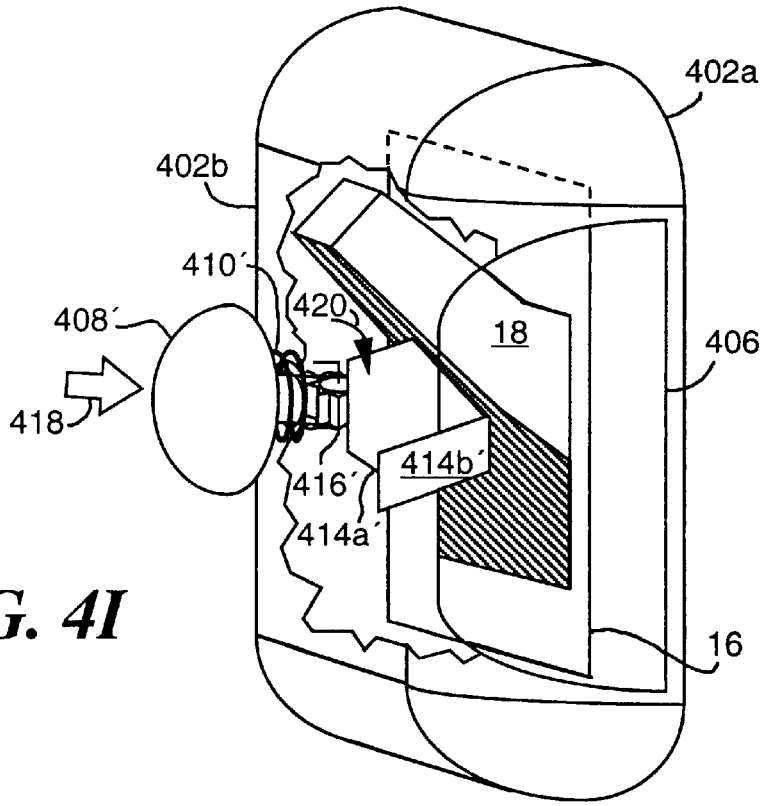
FIG. 4I is an isometric view diagram of an electric-switch cover in the forced state according to a fourth embodiment of the present invention.

Isometric detail views of the fourth embodiment of the present invention may be seen in for the relaxed and forced positions in FIGS. 4H and 4I respectively. In FIG. 4H, the cover housing portions 402*a* and 402*b* are shown with cover aperture 406 and the toggle in the upward position 18 within the toggle mount 16. The items enclosed within the cover housing are depicted in lighter tone than those items along the exterior of the cover housing. The push button 408 attached to a threaded shaft with helical screw 412*b* may be forced forward of the cover front housing 402*b* by the helical spring 410. Within the cover housing is the pinion 416 that engages the helical screw 412*b*. The pinion 416 may be free to rotate and secured to the cover front housing 402*b* by an axle attachment 416*a*. Rigidly connected with the pinion 416 is the attaching flange 414*a*, to which the engaging flange 414*b* is connected. The engaging flange 414*b* impedes the movement of switch-toggle by its presence as a physical obstacle.

In FIG. 4I, the cover housing portions 402*a* and 402*b* are depicted again with cover aperture 406 and the toggle in the upward position 18 within the toggle mount 16. The push button 408' is shown depressed by applied force 418, compressing the helical spring 410' between the bottom of the push button 408' and the exterior of the cover front housing 402*b*. Translation of the helical screw 412*b*' together with the push button 408' rotates the pinion 416' by angle 420. The rotatable jaw with attachment and engagement flanges 414*a*' and 414*b*', rotates with the pinion 416', thereby removing engagement flange 414*b*' from serving to obstruct the switch-toggle. It may be noted that this angle 420 may be oriented in the clockwise direction looking from the top (as in FIG. 4A) if the push button 408 and accompanying elements are located to the left of the switch toggle as shown in FIG. 4I. Conversely, the angle 420 may be rotated counter-clockwise if the push button 408 and accompanying elements are arranged to the right of the switch-toggle as shown in FIG. 4G inverted upside-down. The inventive characteristics of the device remain independent of lateral symmetry.

While embodiments and applications of the invention have been shown and described, it would be apparent to those of ordinary skill in the art, after a perusal of the within disclosure, that many more modifications than mentioned above are possible without departing from the inventive concepts herein. The invention, therefore, is not to be restricted except in the spirit of the appended claims.

What is claimed is:

1. A switch cover for releasably restricting a switch-toggle, said switch cover removably attachable to a conventional wall-mounted electrical switch having said switch-toggle rotatably positionable to one of a current-on switch position and a current-off switch position across a switch arc volume in a toggle movement, said switch cover comprising:

an attachment for removably securing the switch cover to the electrical switch;

a movable flange for impeding toggle movement of the switch-toggle, wherein said movable flange has a passive position and a forced position;

a spring for holding said movable flange in said passive position, said spring connected with said movable flange so that said spring and said movable flange can move coöperatively; and a release for controllably retracting said spring, wherein said movable flange is moved to said forced position if a force is applied so as to allow the switch-toggle to be positioned from a first position to a second position, said first position and second position being one of either the current-on position to the current-off position, wherein said first position differs from said second position.

2. A switch cover according to claim 1 wherein said attachment further comprises:

a cover housing.

3. A switch cover according to claim 2 wherein said cover housing has an aperture for accessing the switch-toggle.

4. A switch cover according to claim 1 wherein said spring further comprises:

a helical coil.

5. A switch cover according to claim 4 wherein said release further comprises:

a pull tab.

6. A switch cover according to claim 5 wherein said movable flange further comprises:

a double-leaf spring, wherein said double-leaf spring is held in said relaxed position by tensile force from said helical coil, wherein said double-leaf spring contracts to said forced position if a pulling force is applied to said pull tab.

7. A switch cover according to claim 4 wherein said release further comprises:

a push button held away from said attachment by said helical coil;

a threaded shaft rigidly connected with said push button; and a pinion rigidly connected with said movable flange, said pinion coöperating with said threaded shaft to rotate said movable flange when said threaded shaft is translated by said force being applied against said push button towards said attachment.

8. A switch cover according to claim 7 wherein said movable flange further comprises a rotatable jaw having:

an attaching flange having a first end and a second end, wherein said first end is rigidly connected with said pinion so as to rotate together with said pinion; and an engaging flange having a first end, a second end and a planform therebetween, wherein said first end of said engaging flange is rigidly connected with said second end of said attaching flange, and said planform impedes the toggle movement of the switch-toggle when said rotatable jaw is in said rest position.

9. A switch cover according to claim 8 wherein said planform of said engaging flange may contour a boundary formed by the switch arc volume as a contour shape.

10. A switch cover according to claim 9 wherein said contour shape further includes a gap for allowing the switch-toggle to be positioned in a third position between said first position and said second position.

11. A switch cover according to claim 1 wherein said release is a push lever, wherein said push lever is rigidly connected to said movable flange, wherein said spring torsionally holds said push lever away from said attachment in said relaxed position.

12. A switch cover according to claim 11 wherein said spring further comprises:

a helical coil forming a hinge axis having a first end and a second end, said helical coil having a first extension engaging at said first end for engaging said push lever, and a second extension at said second end for engaging said attachment.

13. A switch cover according to claim 1 wherein said release and movable flange further comprise:

a push button for said release; and a plurality of linkages for said movable flange, said plurality of linkages connected with said push button.

14. A switch cover according to claim 13 wherein said plurality of linkages further comprises:

an outer flange having an outer end and an inner end, wherein said outer end is rotatably connected to said push button, wherein said push button translates linearly towards said attachment if a force is applied against said push button to compress said spring, and wherein said outer end of said outer flange translates together with said push button; and an inner flange having an outer end and an inner end, said outer end of said inner flange rotatably connected to said inner end of said outer flange, and said inner end of said inner flange is rigidly connected to said movable flange, wherein said movable flange rotates away from the switch-toggle if said force is applied against said push button.

15. A switch cover according to claim 14 wherein said plurality of linkages further includes:

a restraining flange having an outer end and an inner end, said outer end rotatably connected to said attachment, and said inner end rotatably connected to said inner flange.

16. A switch cover according to claim 14 wherein said plurality of linkages further includes:

a sliding axle for guiding said outer flange.

17. A switch cover according to claim 1 further comprising a retractable device for restraining said shaft from being released to the relaxed position.

18. A method for a switch cover to releasably restrict a switch-toggle, said switch cover being removably attachable to a conventional wallmounted electrical switch having said switch-toggle rotatably positionable to one of a current-on switch position and a current-off switch position across a switch arc volume in a toggle movement, said switch cover comprising:

removably securing the switch cover to the electrical switch by an attachment mechanism;

impeding movement of the switch-toggle by a movable flange, wherein said movable flange has a passive position and a forced position;

holding said movable flange in said passive position by a spring, said spring movably connected with said movable flange; and controllably retracting said spring by a release mechanism, wherein said movable flange is moved to said forced position so as to allow the switch-toggle to be positioned from a first position to a second position, said first position and second position being one of either the current-on position to the current-off position, wherein said first position differs from said second position.

19. A method according to claim 18 further comprising:

releasably restraining said shaft from being released to the relaxed position.

* * * * *